US006481925B1

(12) United States Patent
Olson

(10) Patent No.: US 6,481,925 B1
(45) Date of Patent: Nov. 19, 2002

(54) PAVING WORK MACHINE AND METHOD OF TRANSFORMING THE SAME

(75) Inventor: Dale Olson, Hamel, MN (US)

(73) Assignee: Caterpillar Pavimg Products Inc, Minneapolis, MN (US)

( * ) Notice: Subject to any disclaimer, the term of this patent is extended or adjusted under 35 U.S.C. 154(b) by 9 days.

(21) Appl. No.: 09/704,009

(22) Filed: Nov. 1, 2000

(51) Int. Cl.[7] ..... E01C 19/12

(52) U.S. Cl. ..... 404/108; 404/104; 404/101; 404/75; 414/505; 414/523

(58) Field of Search ..... 404/101, 104, 404/105, 108, 110, 118, 75; 414/523, 503–505

(56) References Cited

U.S. PATENT DOCUMENTS 1,851,424 A * 3/1932 Flynn ..... 404/101
3,540,359 A 11/1970 Swisher et al.
4,534,674 A 8/1985 Cutler
4,818,139 A 4/1989 Brock
4,861,191 A 8/1989 Smith
5,009,546 A 4/1991 Domenighetti
5,035,534 A 7/1991 Brock
5,100,277 A 3/1992 Musil
5,190,400 A 3/1993 Sterner
5,269,626 A 12/1993 Soliman et al.
5,452,966 A 9/1995 Swisher
5,529,434 A 6/1996 Swisher
5,533,828 A 7/1996 Campbell
5,533,829 A 7/1996 Campbell
5,553,968 A 9/1996 Campbell
5,590,976 A 1/1997 Kilheffer et al.
5,863,149 A * 1/1999 Gustin ..... 404/104
5,921,708 A 7/1999 Grundl
6,332,736 B1 * 12/2001 Cape et al. ..... 404/75

* cited by examiner

*Primary Examiner*—David Bagnell
*Assistant Examiner*—Sunil Singh
(74) *Attorney, Agent, or Firm*—Jeff A. Greene

(57) ABSTRACT

A work machine is provided and adapted for use in paving operations. The work machine has a conveying system for moving paving material from a first end portion to a predetermined distance beyond a second end portion. A receiving portion is included on the second end portion and is adapted to receive a plurality of operational attachments. The plurality of attachments transforms the work machine into three distinct machines that perform different paving operations.

19 Claims, 5 Drawing Sheets

PAVING WORK MACHINE AND METHOD OF TRANSFORMING THE SAME

TECHNICAL FIELD

The invention relates generally to work machine used in the paving industry, and more specifically to a work machine that can be transformed into three distinct paving machines.

BACKGROUND ART

Present day paving operations require many different machines that each performing different functions. When an existing road is under reconstruction different machines are used in preparing the road for resurfacing. One machine is a cold planer or milling machine mills the top surface of the road removing high points and prepares the surface for better adhesion to a bituminous mixture. Another type of machine used in preparation and finishing of a road is known as a road widener. An exemplary machine is shown in U.S. Pat. No. 4,861,191 issued on Aug. 29, 1989 and assigned to the owner of the present application. This machine is used to replenish the aggregate at the shoulder of a finished road and is also used to lay a strip of bituminous material at the edge of a road to build a base when widening an existing road.

When a road is being laid or an existing road is being resurfaced different machines are required. A machine used to resurface or lay a new road is commonly referred to as a paver. The paver receives a hot or cold bituminous aggregate mixture and distributes the mixture to the rear of the machine and spreads a mate of a predetermined wide by a floating screed assembly attached to the rear of the paver. One such machine is shown in U.S. Pat. No. 5,533,829 issued Jul. 9, 1996 assigned to Astec Industries, Inc. Still yet another machine is commonly referred to as a transfer machine. An example of a transfer machine is shown in U.S. Pat. No. 5,100,277 issued Mar. 31, 1992 assigned to Cedarapids, Inc. The transfer machine is capable of receiving the bituminous mixture from a transport truck and elevating the mixture and transferring the mix to the paver.

Present day machines for the road construction industry are dedicated machines and have been designed to perform a single function. The machines require the contractor to lay out a large amount of capital. Each machine has it own engine and propel system and is transported to the sight by the contractor and sits idle at the sight until needed. In the event of a break down a replacement machine if available needs to be trucked in.

The present invention is directed to overcoming one or more of the problems as set forth above.

DISCLOSURE OF THE INVENTION

In one aspect of the present invention a work machine is adapted for use in the production of roads is provided. The work machine has a self-propelled chassis. The chassis has a first end portion, a second end portion, and a pair of opposing sides and is supported by a propelling arrangement. An aggregate conveying system has a first end, a second end and a hinge point positioned between the first and second ends. The second end of the aggregate conveying system is pivotally movable between a first horizontal position and second elevated position.

In anther aspect of the present invention a method for converting a work machine into three distinct machines comprises two steps. First providing a self-propelled chassis that has a first end portion, a second end portion, and a pair of opposing sides is supported by a propelling arrangement. The self-propelled chassis includes a conveying system that has a first end, a second end and a hinge point positioned between the first and second ends. The second end of the conveying system is pivotally movable between a first horizontal position and second elevated position. Second, attaching a plurality of attachments to the second end portion of the self-propelled chassis.

BEST MODE FOR CARRYING OUT THE INVENTION

Figure 1:
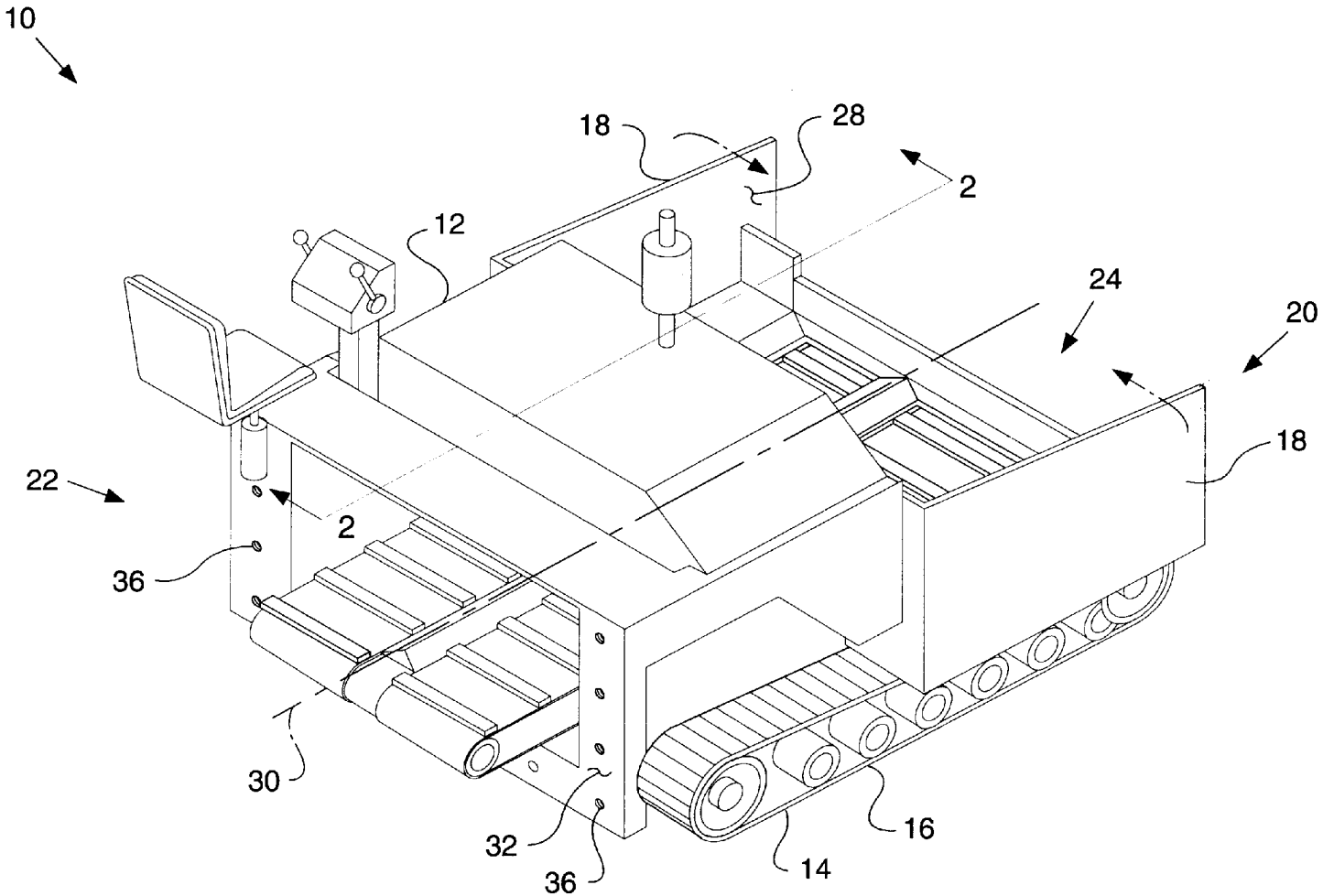
FIG. 1 is a perspective view of a work machine of the present invention.

Referring to FIG. 1, a work machine 10 is shown for use in the production of paving lots and roadways. The work machine 10 includes a self-propelled chassis 12 that is supported by a propelling arrangement 14. The propelling arrangement 14 is a pair of track roller assemblies 16 positioned on opposing sides 18 of the chassis 12. It should be understood that any other known arrangement for supporting and propelling the work machine 10 would work, such as driven wheels, linked track and rubber belts are interchangeable without departing from the spirit of the present invention.

The self-propelled chassis has a first end portion 20 and a second end portion 22. A hopper 24 is positioned in the first end portion 20 that is adapted to receive paving material. The paving material can be an aggregate or a bituminous mixture that is deposited in the hopper 24 from a truck during a paving operation. The first end portion 20 includes a power dumping arrangement 28 capable of tiltably moving, as indicated by arrows in FIG. 1, the paving material towards a center axis 30 of the hopper 24. The second end portion 22 includes a receiving portion 32 that is adapted to receive a plurality of attachments 34. The receiving portion 32 includes an aligning and fastening arrangement 36 that can include bolt patterns, locating pins, mechanical or hydraulic clamps, or any other such known mechanism of alignably positioning and fastening machine components together.

Figure 2:
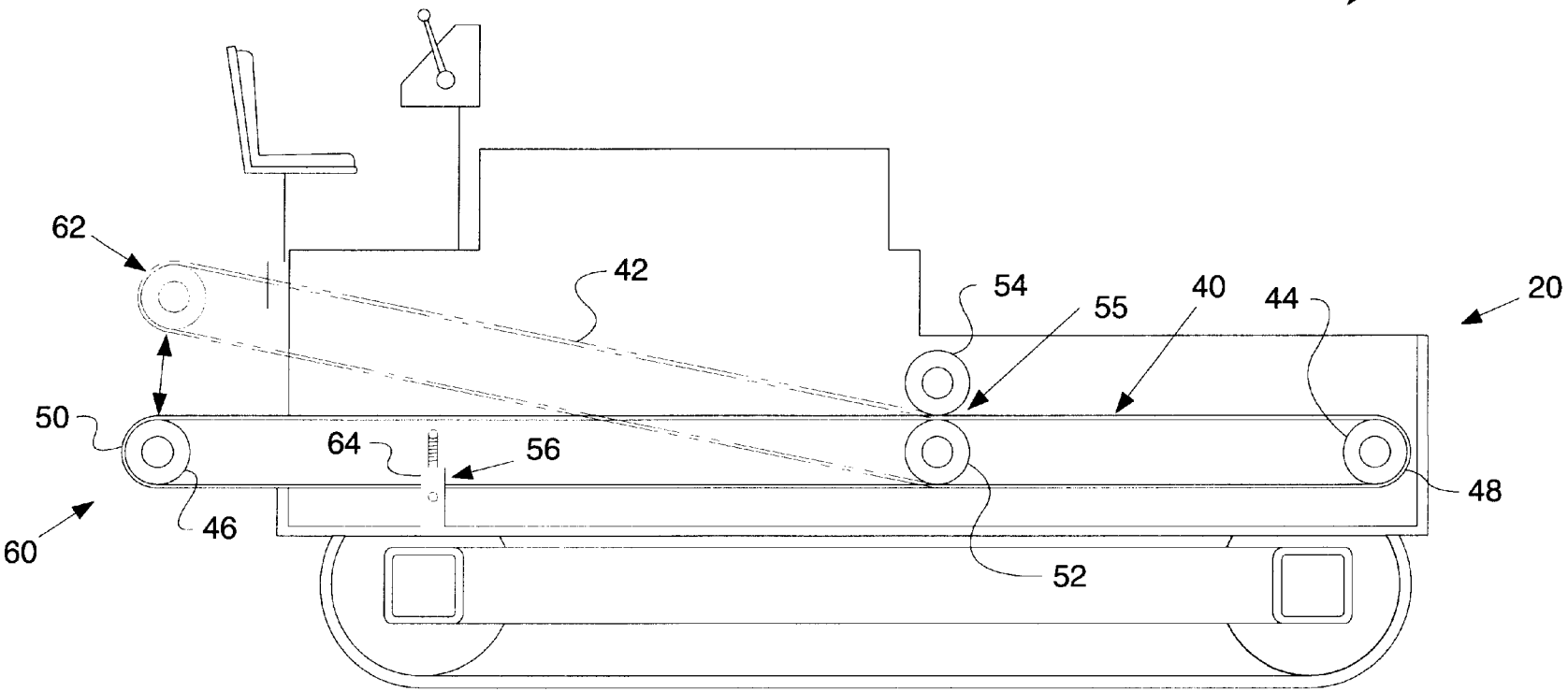
FIG. 2 is a cross sectional view taken along line 2—2 of FIG. 1.

With reference to FIG. 2, a conveying system 40 is positioned between the opposing sides 18 of the chassis 12 and extends from the first end portion 20 and a predetermined distance beyond the second end portion 22. The conveying system 40 has at least one endless loop conveyor belt/drag chain 42, but generally has one positioned on each side of the center axis 30, entrained around and supported by first and second shafts 44,46. The conveyor belt/drag chain 42 makes a first end 48 as it wraps around the first shaft 44 and a second end 50 as it wraps around the second shaft 46. The conveyor belt/drag chain 42 is driven by either the first shaft 44 or the second shaft 46, in a known manner, for moving the paving material from the first end portion 20 towards the second end portion 22 of the chassis 12.

A third shaft or idler 52 is positioned at a predetermined location between the first and second end 48,50. Guides 54 or rollers are positioned adjacent the third shaft 52 and above the conveyor belt/drag chain 42. The third shaft 52 and guides 54 act as a hinge point 55 for the conveyor belt/drag chain 42 and allow an actuator 56 to pivotally move the second end 50 between a first horizontal position 60 and a second elevated position 62. Actuator 56 is shown in FIG. 2 as being a single fluid cylinder 64, in actuality one fluid cylinder 64 would be used for each side of the conveyor belt/drag chain 42. It should also be understood that other actuators such as motors, jack screws and the like would also work equally as well for pivotally moving the second end 50 between the first and second positions 60,62.

Figure 3:
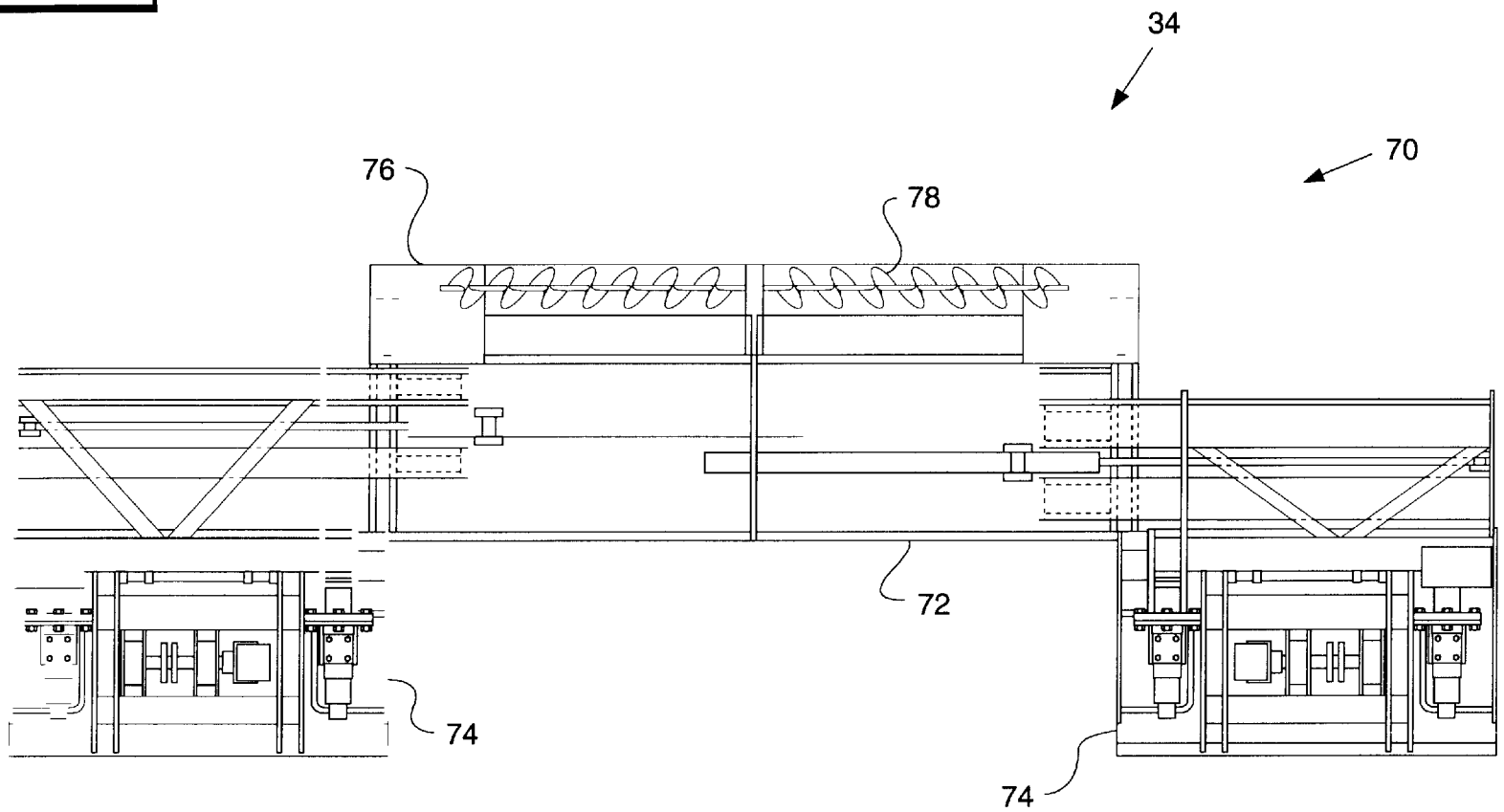
FIG. 3 is a plan view of a screed attachment.

Referring now to FIG. 3 a plan view of a screed attachment 70 is shown. The screed attachment 70 has a main screed 72 and at least one powered screed extension 74. As known in the industry the screed extensions allow for varying the overall width of paving capability of the work machine 10 and can be front mounted or rear mounted as seen in FIG. 3. Screed attachment 70 also includes a mounting portion 76 that is adapted to mate with the aligning and fastening arrangement 36 of the receiving portion 32 at the second end portion 22 of the work machine 10. A material distribution system 78 is also positioned behind the mounting portion 76 and below the second end 50 of the conveying system 40 for evenly distributing paving material to the main screed 72 and the screed extensions 74.

Figure 4:
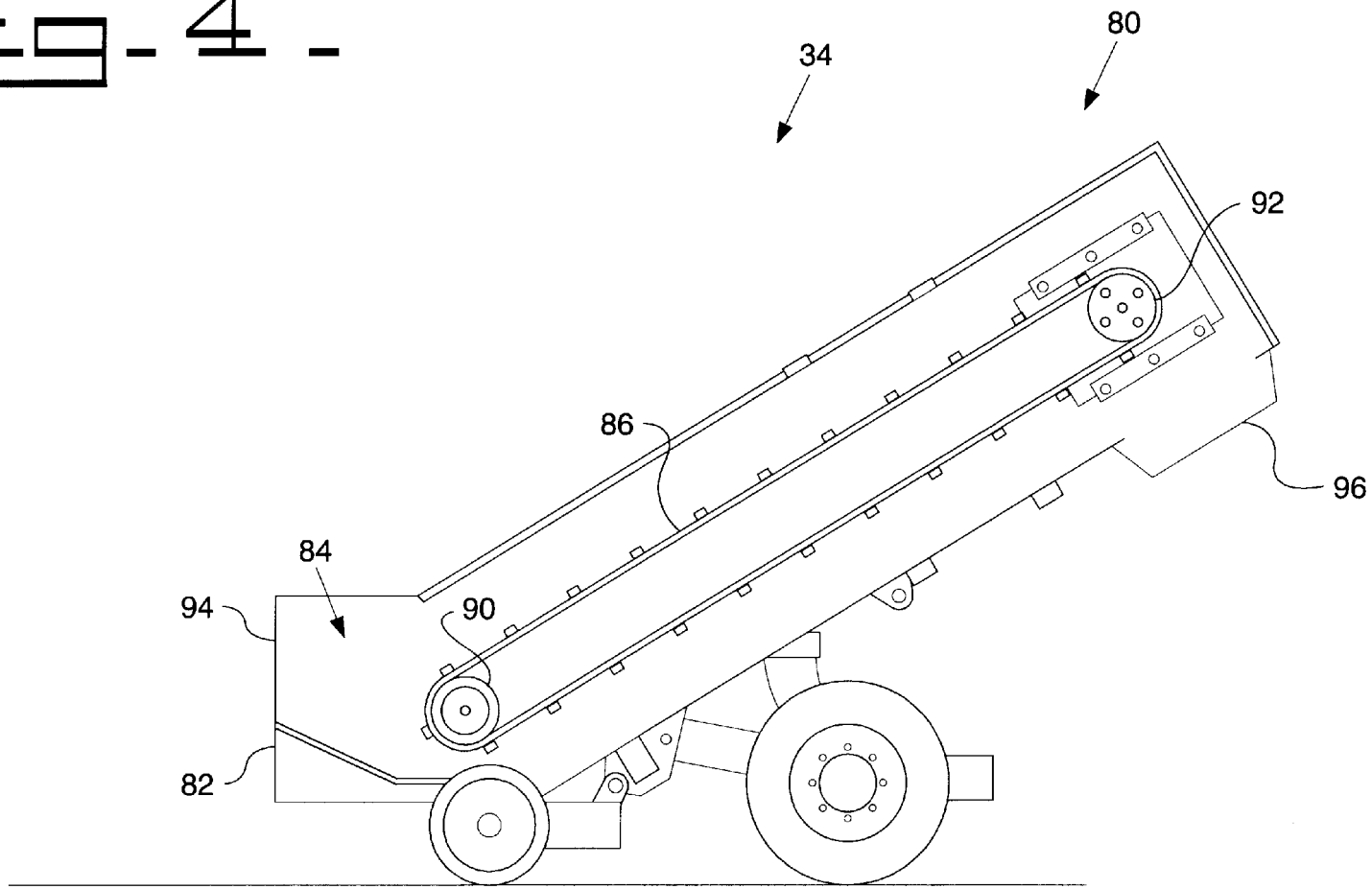
FIG. 4 is a side view of a material transfer attachment.

FIG. 4 shows another one of the attachments 34, which is a material transfer attachment 80. The material transfer attachment 80 also has a mounting portion 82 that is adapted to mate with the aligning and fastening arrangement 36 of the receiving portion 32 of the work machine 10. An aperture 84 is positioned behind the mounting portion 82 and is used to funnel paving material to an elevating conveyor system 86. The elevating conveyor system 86 has at least one endless loop conveyor belt/drag chain 86 entrained around first and second shafts 90,92. The conveyor belt/drag chain 86 is driven, in a known manner, for moving paving material from a first location 94 towards a second elevated location 96.

Figure 5:
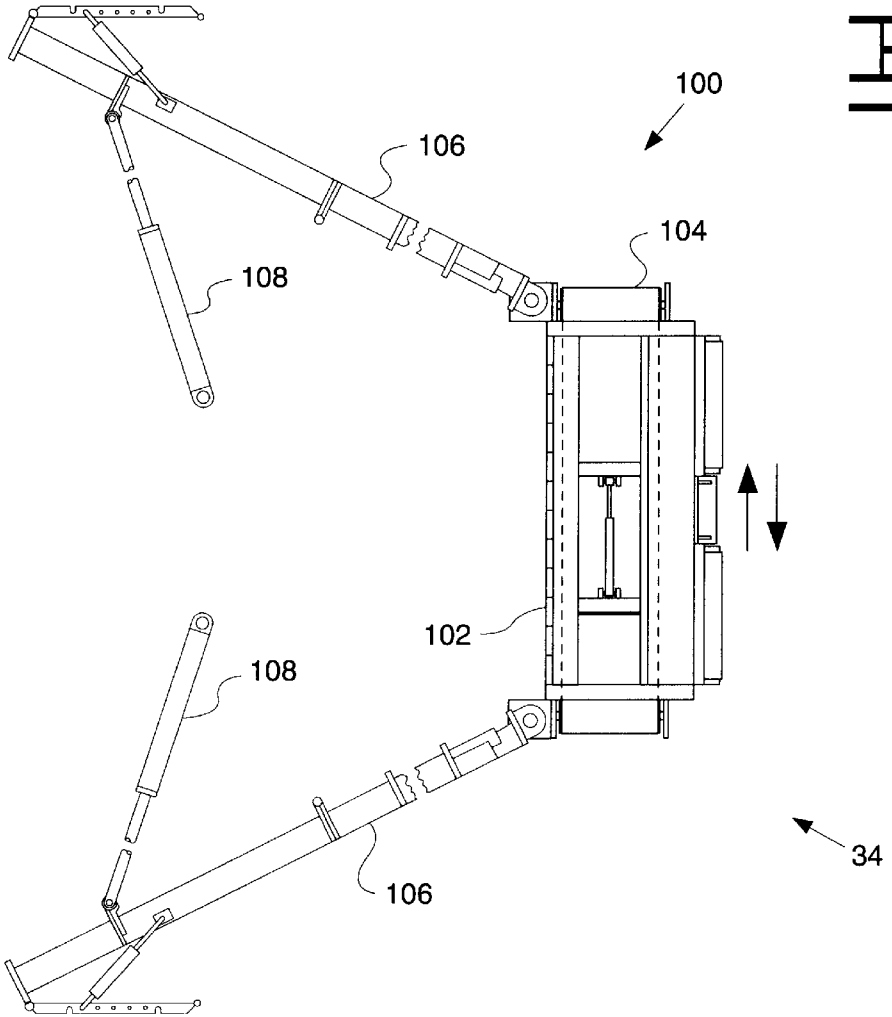
FIG. 5 is a plan view of a road widener assembly.

Referring now to FIG. 5 yet another attachment 34 is shown as being a road widening attachment 100. The road widening attachment 100 has a mounting portion 102 that is adapted to mate with the aligning and fastening arrangement 36 of the receiving portion 32 of the work machine 10. The road widening attachment 100 includes a conveyor belt/drag chain 104 that is driven in such a manner that it can move the paving material to either of the opposing sides 18 of the work machine 10. The conveyor belt/drag chain 104 is also mounted on rollers not shown so that it can extend a predetermined distance from either of the opposing sides 18. A pair of strike-off tools 106 are pivotally connected to the road widening attachment 100 for leveling the paving material deposited by the conveyor belt/drag chain 104 on either of the opposing sides 18. A telescoping support arm 108 pivotally attaches to the self-propelled chassis 12 when the road widener attachment 100 is mounted on the work machine 10. The pair of strike-off tools 106 are movable from a retracted position to a working position.

Industrial Applicability

In operation as a specific paving operation is required the work machine 10 is converted to perform one of three distinct paving functions. For example, if an existing road is being widened the road widener attachment 100 is secure to the second end portion 22 of the self-propelled chassis 12. This converts the work machine 10 into a road widener for to performing widening operations.

When the widening operations are completed the road widener attachment 100 is removed and the screed attachment 70 can be secured to the second end portion 22 of the self-propelled chassis 12 in its place. This converts the work machine 10 to perform paving operations.

On large highway operations the material transfer attachment 80 is secured to a second work machine 10 and work in front of and in tandem with work machine 10 that has a screed attachment 70 secure to the second end portion 22. This allows the rear work machine 10 to lay a continuous mat of paving material while the front work machine 10 transfers material supplied by trucks to the rear work machine 10. Thus minimizing the starting and stopping of the paving operation between truck loads of paving material.

The present invention offers contractors great flexibility to transfer the plurality of attachments 34 from work machine 10 to work machine 10 in the event of break downs and scheduled maintenance and also reduces the number of dedicated machines that have to be transported from one job sight to another.

Other aspects, objects, and features of the present invention can be obtained from a study of the drawings, the disclosure, and the appended claims.

What is claimed is:

1. A work machine (10) adapted for use in paving operations comprising:

a self-propelled chassis (12) having a first end portion (20), a second end portion (22), and a pair of opposing sides (18) and being supported by a propelling arrangement (14);

a conveying system (40) having a first end (48), a second end (50) and a hinge point (55) positioned between the first and second end portions (20,22) and the pair of opposing sides (18); and an actuator (56) operatively connected to said conveying system between the first and second end portions (20,22), said actuator (56) pivotally moving said second end (50) of said conveying system (40) between a first horizontal position (60) and second elevated position (62).

2. The work machine of claim 1 wherein said conveying system is positioned between the pair of opposing sides and longitudinally extending from the first end portion and a predetermined distance beyond the second end portion of said self-propelled chassis.

3. The work machine of claim 1 wherein the second end of said conveying system is pivotal by an actuator.

4. The work machine (10) of claim 1 wherein the second end portion (22) of the self-propelled chassis (12) having one of a plurality of attachments (34) attached thereto.

5. The work machine of claim 4 wherein said one of a plurality of attachments include a road widener attachment.

6. The work machine (10) of claim 5 wherein said road widener attachment (100) includes a conveyor belt/drag chain (104) adapted to receive paving material from said conveying system (40) and operable to move the material (26) to one of the opposing sides (18) of said self-propelled chassis (12).

7. The work machine (10) of claim 5 wherein said road widener attachment (100) includes a pair of strike-off tools (106) supported on the road widener attachment (100), each of said pair of strike-off tools (106) being movable from a retracted position to a working position.

8. The work machine of claim 4 wherein said one of a plurality of attachments include a screed attachment.

9. The work machine of claim 8 wherein said screed attachment includes at least one adjustable screed extension.

10. The work machine of claim 4 wherein said one of a plurality of attachments include a material transfer attachment.

11. The work machine (10) of claim 10 wherein said material transfer attachment (80) receives paving material from the conveying system (40) and discharges the paving material at an elevated location.

12. A work machine (10) adapted for use in paving operations comprising:

a self-propelled chassis (12) having a first end portion (20), a second end portion (22), and a pair of opposing sides (18) and being supported by a propelling arrangement (14);

a conveying system (40) having a first end (48) and a second end (50), and a hinge point (55) positioned between the first and second end portions (20,22) and the pair of opposing sides (18);

an actuator (56) operatively connected to said conveying system between the first and second end portions (20,22), said actuator (56) pivotally moving said second end (50) of said conveying system (40) between a first position (60) and second position (62); and a receiving portion (32) is positioned at the second end portion (22) of the self-propelled chassis (12) having one of a plurality of attachments (34) attached thereto.

13. The work machine of claim 12 wherein said one of a plurality of attachments include a screed attachment.

14. The work machine (10) of claim 12 wherein said one of a plurality of attachments (34) include a road widener attachment (100).

15. The work machine (10) of claim 12 wherein said one of a plurality of attachments (34) include a material transfer attachment (80).

16. A method for converting a work machine (10) into three distinct machines comprising the steps of:

providing a self-propelled chassis (12) having a first end portion (20), a second end portion (22), and a pair of opposing sides (18) and being supported by a propelling arrangement (14), said self-propelled chassis (12) including a conveying system (40) having a first end (48), a second end (50) and a hinge point (55) positioned between the first and second end portions (20, 22) and the pair of opposing sides (18), an actuator (56) operatively connected to said conveying system between the first and second end portions (20,22), said actuator (56) pivotally moving said second end (50) of said conveying system (40) between a first horizontal position (60) and second elevated position (62); and attaching one of a plurality of attachments (34) to the second end portion (22) of the self-propelled chassis (12).

17. The method of claim 16 wherein said attaching step includes attaching a screed attachment (70) to said second end portion (22).

18. The method of claim 16 wherein said attaching step includes attaching a road widener attachment (104) to said second end portion (22).

19. The method of claim 16 wherein said attaching step includes attaching a material transfer attachment (80) to said second end portion (22).

* * * * *